United States Patent [19]

Nakama

[11] Patent Number: 5,037,496

[45] Date of Patent: Aug. 6, 1991

[54] COBALT-CONTAINING PRECIOUS METAL MATERIAL FOR DECORATION

[75] Inventor: Kiyoshi Nakama, Hiratsuka, Japan

[73] Assignee: Tanaka Kikinzoku Kogyo K.K., Japan

[21] Appl. No.: 470,903

[22] Filed: Jan. 26, 1990

[30] Foreign Application Priority Data

Jan. 26, 1989 [JP] Japan ..... 1-17225

[51] Int. Cl.[5] ..... C23C 8/02

[52] U.S. Cl. ..... 148/430; 148/431; 148/281; 148/286; 204/37.1; 204/37.6

[58] Field of Search ..... 148/430, 431, 281, 286; 204/37.1, 37.6

[56] References Cited

U.S. PATENT DOCUMENTS 1,565,200 12/1925 Reeve ..... 148/430

4,504,327 3/1985 Inomata et al. ..... 148/304

*Primary Examiner*—R. Dean

*Assistant Examiner*—Margery S. Phipps

*Attorney, Agent, or Firm*—Klauber & Jackson

[57] ABSTRACT

Disclosed herein is cobalt-containing precious metal material for decoration which comprises cobalt and one or more precious metals selected form the group consisting of Au, Ag, Pt and Pd, at least the cobalt on the surface being oxidized.

Also disclosed herein is a process for preparing cobalt-containing precious metal material for decoration which comprises blending cobalt and one or more precious metals selected from the group consisting of Au, Ag, Pt and Pd, and oxidizing the blend in an oxidative atmosphere so as to form the oxidized cobalt on the surface of the material.

3 Claims, No Drawings

COBALT-CONTAINING PRECIOUS METAL MATERIAL FOR DECORATION

BACKGROUND OF INVENTION

This invention relates to cobalt-containing precious metal material employed for the manufacture of decorated articles, personal ornaments, glass frames, keys and the like, and a process for manufacturing the material.

Heretofore, in order to manufacture decorated articles or personal ornaments, such as glass frames, keys and the like, Ag-type, Au-type, Au-Ag-Cu ternary alloys and Pt-type materials have been employed. The Ag-type materials exhibit a color represented by a unique white brightness or a silvery color, while the Au-type materials, such as Au-Ag-Cu ternary alloys are capable of obtaining only a simple hue represented by white, yellow and red. The Pt-type material is comparable to the Ag-type materials in near brightness at the equivalent thickness levels although not as decorative as the Au-type materials.

These days the materials that are employed for the above uses, require peculiar colors which have not previously existed. In addition to satisfying the needs of fashion, design and intrinsic decorative effects achieved by the materials, account must be taken of the costs of the metals and their availability.

In order to comply with such a need, some attempts have been conventionally made to bring out blackish gray by means of a sulfide film and blue by means of an oxide film on an Au-Fe (24%) alloy, but no practical uses have been realized.

Precious metals usually have bright colors, and no precious metal materials having black appearance have been known. The precious metal materials having black appearance were developed, they could have a great impact on the precious metal industry.

SUMMARY OF INVENTION

Accordingly, an object of the present invention is to provide cobalt-containing precious metal material for decoration having a peculiar black luster being rich in fashionable features.

Another object of this invention is to provide cobalt-containing precious metal material having sufficient strength and hardness and being resistant to damage and deformation.

A still further object of this invention is to provide cobalt-containing precious metal material with no or less structural defects.

The cobalt-containing precious metal material of this invention for overcoming the above problems and attaining the said objects comprises cobalt and one or more precious metals selected form the group consisting of Au, Ag, Pt and Pd with at least the cobalt on the surface being oxidized.

Another feature of the present invention is a process for preparing cobalt-containing precious metal material for decoration which comprises blending cobalt and one or more precious metals selected from the group consisting of Au, Ag, Pt and Pd, and oxidizing the blend in an oxidative atmosphere so as to form the oxidized cobalt on the surface of the material.

DETAILED DESCRIPTION OF THE INVENTION

The cobalt-containing precious metal material for decoration may be obtained by blending such a precious metal as Au, Ag, Pt, and Pd with cobalt followed by oxidation under such oxidative conditions as atmospheric. The balance of the material may be any metal, and the material may consist of only the cobalt and the said precious metals and no balance exists. The blending process is not particularly restricted. All the component metals may be mixed all at once, or a precious metal alloy consisting of, for example, Au and Cu may be admixed under heating with cobalt. By the oxidation of the blend containing at least the cobalt and one or more precious metals, a firm and stable coating of a black external appearance can be formed, which is lustrous and unique, and which is not removable by an external force such as grinding.

It seems that during the oxidation the cobalt existing deep in the material migrates to the surface where it is oxidized. With the lapse of the oxidation period, therefore, the surface concentration of the cobalt oxide seems to increase so that the depth of the color can be controlled.

Further, the cobalt contained in the material exhibits superior mechanical strength and hardness so that the material or any article produced therefrom possesses excellent resistance to damage and deformation.

The cobalt contained in the material displays deoxidation effect when the material is dissolved or cast in the processing so as to remove oxygen which may bring about the corrosion of the material, from the said material.

After the cobalt is blended with the precious metal or the like, the blend is oxidized such as by atmospheric oxygen to form the cobalt-containing precious metal material on the surface of which is formed a coating or film containing cobalt oxide. The conditions for this oxidation may be so adjusted that the thickness the coating formed is preferably 0.1 to 10 $\mu$m. When the thickness is below 0.1 $\mu$m, the film is liable to be damaged during the treatment so that the surface of the alloy is exposed, and when the thickness exceeds 10 $\mu$m, the operation efficiency is lowered. Of course, the thickness of the film shall not be restricted thereto.

Preferable conditions of the oxidation are as follows.

Oxidation Period: 15 min to five hours

Temperature: 400° C. to 1100° C.

Circumstance: Atmosphere

After the oxidation, the cobalt-containing precious metal material may be buff-polished. Further, in order to facilitate the polishing operation, the material may be treated with an acid before the polishing.

As is apparent from the foregoing description, since the firm and stable coating is formed on the cobalt-containing precious metal material for decoration of the present invention by means of the oxidation of the cobalt, the material having the peculiar appearance with the black luster can be obtained which is not removed even by such an external force as polishing. Therefore, when decorated articles, personal ornaments, glass frames, keys and the like are manufactured with said cobalt-containing precious metal material, the articles with abundant fashionable features can be obtained.

Since the cobalt is contained in the cobalt-containing precious metal material, the material possesses elevated mechanical strength and high hardness and is hard to be damaged and to be deformed. The contained cobalt displays deoxidation effect during dissolution and casting to provide the material having no defects such as pin holes.

The invention will now be illustrated by Examples which, however, is to be considered a merely exemplary of practice of the invention, and not as delimitive thereof.

EXAMPLES 1

An alloy of Ag-Cu(7%)—Co(8%) was prepared from a mother alloy of Cu-Co (33%) and Ag. This alloy was rolled and thermally treated in the atmosphere at 750° C. for one hour to form the oxidation coating of the cobalt having 0.3 μm of thickness on the surface of the alloy. After the alloy was rapidly cooled in water and was polished with buff, the cobalt-containing precious metal material having black luster was obtained.

EXAMPLE 2

An alloy of Au-Ag(3%)—Cu(12%)—Co(5%) was prepared from a mother alloy of Cu-Co (33%), Au and Ag. This alloy was rolled and thermally treated in the atmosphere at 800° C. for one hour to form the oxidation coating of the cobalt having 0.3 μm of thickness on the surface of the alloy. After the alloy was rapidly cooled in water and was polished with buff, the cobalt-containing precious metal material having black luster was obtained.

EXAMPLE 3

Then, a third Example will be described.

An alloy of Pt-Pd(10%)—Cu(5%)—Co(5%) was prepared from a mother alloy of Cu-Co (33%), Pt and Pd. This alloy was rolled and thermally treated in the atmosphere at 1000° C. for one hour to form the oxidation coating of the cobalt having 0.3 μm of thickness on the surface of the alloy. After the alloy was rapidly cooled in water and was polished with buff, the cobalt-containing precious metal material having black luster was obtained.

Although the present invention has been described in its preferred Examples, it is rapidly understood that the present invention is not restricted thereto, and various changes and the modifications may be made in the present invention by those skilled in the art without departing from the spirit and scope of the present invention.

What is claimed is:

1. Cobalt-containing precious metal based material for decoration which comprises cobalt and a balance of one or more precious metals selected from the group consisting of Au, Ag, Pt and Pd, at least the cobalt on the surface being oxidized, and said cobalt being present in an effective amount to yield a black luster at the said oxidized surface.

2. The cobalt-containing precious metal material for decoration of claim 1, wherein the thickness of the oxidized cobalt is 0. 1 to 10 μm.

3. Cobalt-containing precious metal based material for decoration, which consists essentially of copper, cobalt and a balance of one or more precious metals selected from the group consisting of Au, Ag, Pt and Pd, at least the cobalt on the surface being oxidized, and said cobalt being present in an effective amount to yield a black luster at the said oxidized surface.

* * * * *